US011441574B2

(12) United States Patent
Sankar Ram et al.

(10) Patent No.: US 11,441,574 B2
(45) Date of Patent: Sep. 13, 2022

(54) HVACR BLOWER

(71) Applicant: TRANE INTERNATIONAL INC., Davidson, NC (US)

(72) Inventors: Karthik Sankar Ram, Tamil Nadu (IN); Ramesh Vedula, Karnataka (IN); Nathan Wagers, Panama City, FL (US); Srikanth Kanduri, Telangana (IN)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 17/132,973

(22) Filed: Dec. 23, 2020

(65) Prior Publication Data

US 2021/0199135 A1 Jul. 1, 2021

(30) Foreign Application Priority Data

Dec. 26, 2019 (IN) ..... 201941053901

(51) Int. Cl.
*F04D 29/28* (2006.01)
*F04D 17/08* (2006.01)
*F04D 29/70* (2006.01)

(52) U.S. Cl.
CPC ..... *F04D 29/281* (2013.01); *F04D 17/08* (2013.01); *F04D 29/703* (2013.01); *F05D 2230/60* (2013.01)

(58) Field of Classification Search
CPC ..... F04D 17/08; F04D 29/281; F05D 2230/60
See application file for complete search history.

(56) References Cited

U.S. PATENT DOCUMENTS 2,155,231 A 4/1939 Hubbard et al.
4,428,717 A * 1/1984 Catterfeld ..... F04D 7/04 29/889.4
5,800,128 A 9/1998 Bodmer et al.
6,402,467 B1 * 6/2002 Godichon ..... F04D 29/023 415/200
6,659,723 B2 * 12/2003 Bankstahl ..... F04D 29/263 415/175
6,705,383 B2 3/2004 Beeck et al.
6,854,960 B2 * 2/2005 Van Dine ..... F04D 29/023 156/242
9,523,370 B2 * 12/2016 Goenka ..... F04D 29/30
9,810,235 B2 * 11/2017 Giannozzi ..... F04D 29/2227
9,945,388 B2 4/2018 Palomba et al.
(Continued)

FOREIGN PATENT DOCUMENTS

EP 3315239 B1 12/2019
WO 2020/115540 A1 6/2020

*Primary Examiner* — Ninh H. Nguyen
(74) *Attorney, Agent, or Firm* — Hamre, Schumann, Mueller & Larson, P.C.

(57) ABSTRACT

A blower and method of manufacturing a blower for a heating, ventilation, air conditioning, and refrigeration (HVACR) unit is disclosed. The blower includes a plurality of blower sections. Each section includes a first shroud, a second shroud spaced from the first shroud in a direction of a longitudinal axis of the blower, and a blade. The blade is formed such that a first end of the blade is joined with the first shroud and a second end of the blade is joined with the second shroud. A band is secured to the plurality of blower sections.

20 Claims, 6 Drawing Sheets

(56) References Cited

U.S. PATENT DOCUMENTS

| | | | | |
|---|---|---|---|---|
| 2015/0316073 | A1* | 11/2015 | Lorcher | F04D 17/00<br>416/186 R |
| 2016/0096327 | A1* | 4/2016 | Fry | B29C 64/118<br>264/443 |
| 2018/0209283 | A1 | 7/2018 | Kottilingam et al. | |
| 2018/0238337 | A1* | 8/2018 | Kneip | H02K 1/28 |
| 2020/0070957 | A1 | 3/2020 | Gold et al. | |
| 2020/0200186 | A1 | 6/2020 | Hendron et al. | |

* cited by examiner

HVACR BLOWER

FIELD

This disclosure relates generally to heating, ventilation, air conditioning, and refrigeration (HVACR) systems. More specifically, this disclosure relates to methods and systems for manufacturing and assembling a blower for an HVACR unit.

BACKGROUND

HVACR systems typically employed in, for example, building air conditioning systems often include an air-moving means such as a fan. In some instances, the fan may be a centrifugal fan. Centrifugal fans often are manufactured as two pieces that are then joined together. For example, the bottom shroud and the blades or vanes can be formed as a single piece that is then joined with a top shroud. Cost and complexity of manufacturing can present challenges. Improved fans and manufacturing methods are desired.

SUMMARY

This disclosure relates generally to heating, ventilation, air conditioning, and refrigeration (HVACR) systems. More specifically, this disclosure relates to methods and systems for manufacturing and assembling a plastic blower for an HVACR unit.

A blower for a heating, ventilation, air conditioning, and refrigeration (HVACR) unit is disclosed. The blower includes a plurality of blower sections. Each section includes a first shroud, a second shroud spaced from the first shroud in a direction of a longitudinal axis of the blower, and a blade. The blade is formed such that a first end of the blade is joined with the first shroud and a second end of the blade is joined with the second shroud. A band is secured to the plurality of blower sections. In an embodiment, the band holds the plurality of blower sections together, and can maintain the integrity of the blower as a whole when the sections are joined together.

A method of manufacturing a blower for a heating, ventilation, air conditioning, and refrigeration (HVACR) unit is disclosed. The method includes, forming a plurality of sections of the blower. Each section includes a first shroud, a second shroud spaced from the first shroud in a direction of a longitudinal axis of the blower, and a blade. The blade is formed such that a first end of the blade is joined with the first shroud and a second end of the blade is joined with the second shroud. The method further includes securing a band to the plurality of sections.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

Figure 1:
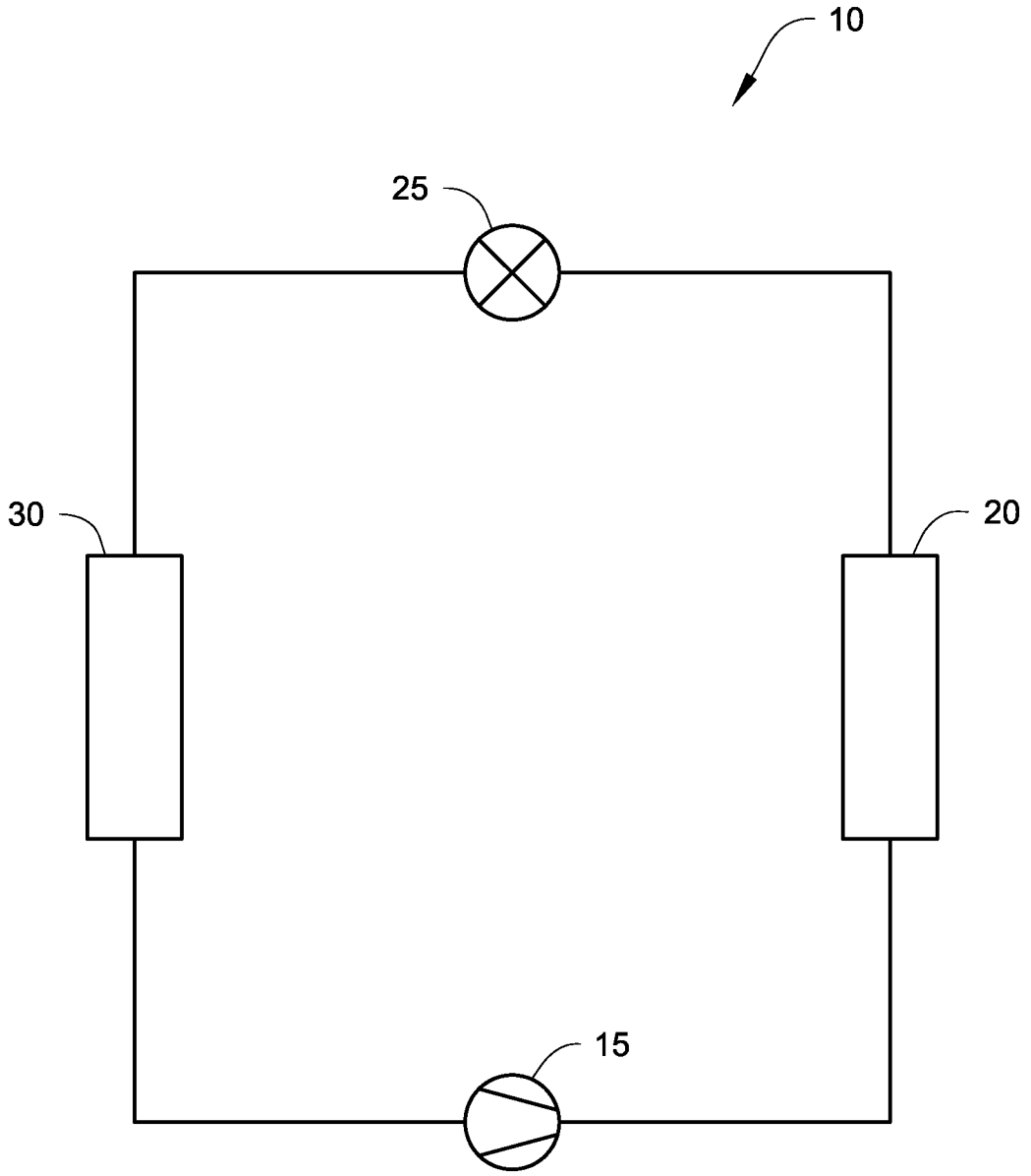
FIG. 1 is a schematic diagram of a heat transfer circuit, according to an embodiment.

This disclosure relates generally to heating, ventilation, air conditioning, and refrigeration (HVACR) systems. As one example, this disclosure relates to methods and systems for manufacturing and assembling a plastic blower for an HVACR unit. It will be appreciated that the methods and systems for manufacturing and assembling a plastic blower, as well as the resulting blower from such methods and systems, may be directed to a standalone blower without the requirement that it be applied to the specific implementation into an HVACR system or product.

Blowers for HVACR units such as, but not limited to, centrifugal blowers for an HVACR unit can be manufactured from two pieces that are then joined together. For example, some blowers may be made of plastic and formed in two separate pieces by, for example, injection molding, or the like. The two separate pieces (often a shroud and blades together as one piece and a second shroud as the second piece) may be manufactured then joined together. As the diameter of the blower increases, complexity of the manufacturing process also increases.

3D printing processes are becoming more widespread. However, the blowers may not be able to be simply 3D printed instead of injection molding. One way of utilizing a 3D printing process as described in this Specification includes dividing the blower into a plurality of similar or identical pieces. The pieces can then be formed by a 3D printing process such as, but not limited to, selective laser sintering (SLS), multi jet fusion (MJF), fused deposition modeling (FDM), or the like. The 3D printing process enables the individual pieces of the blower to be formed in a manner that holds dimensions well and approaches the performance of the injection molded blowers.

In the embodiments described in this Specification, the blower is formed in a plurality of pieces that each includes a first shroud, a blade, and a second shroud collectively formed as a single piece, unitary construction. When assembled, the plurality of pieces provide an arrangement of blades around a common hub. As a result, a size of each piece is reduced in size relative to the entire blower. For example, the size is reduced as a factor of the number of blades in the blower. That is, a 6-bladed blower can include 6 pieces formed individually and assembled together. Thus the embodiments described in this Specification can result in a size of the printed component being $1/6^{th}$ the size of the full blower for the 6-bladed blower. It is to be appreciated that a similar reduction would be made based on a number of blades for the blower (e.g., 12 blades results in $1/12^{th}$ the size, etc.). As a result of reducing an overall size of each individual piece, potential impacts from the 3D printing process such as warping or the like can be reduced.

In an embodiment, each of the individual pieces can include one or more projections and one or more openings to receive one or more projections from another piece. This can, for example, simplify an assembly process of the blower.

In an embodiment, the individual pieces can alternatively be injection molded so that a smaller mold is utilized.

An "HVACR unit," as described herein, can generally include a refrigeration unit including a single compressor or including a plurality of compressors. In some embodiments, one of the plurality of compressors has a greater capacity than another of the plurality of compressors. In some embodiments, the plurality of compressors are fixed speed compressors.

Aspects described in this Specification can be applied to various types of HVACR units, equipment, and/or systems, for example, but not limited to split systems, unitary equipment, rooftop equipment, water source heat pumps, chillers, air handlers, or the like, that utilize a blower. In an embodiment, aspects described in this Specification can be applied to fans that interface with and provide airflow for example to a gas furnace, an electric heater system, or the like. In an embodiment, descriptions herein can be applied to fans that may be implemented into a transport refrigeration system or product, such as but not limited to HVACR in truck, trailer, bus, air handler units, and the like.

FIG. 1 is a schematic diagram of a heat transfer circuit 10, according to some embodiments. The heat transfer circuit 10 generally includes a compressor 15, a condenser 20, an expander 25 (e.g. expansion valve), and an evaporator 30. The heat transfer circuit 10 is exemplary and can be modified to include additional components. For example, in some embodiments the heat transfer circuit 10 can include an economizer heat exchanger, one or more flow control devices (e.g. valve(s)), a receiver tank, a dryer, a suction-liquid heat exchanger, or the like. In some embodiments, the heat transfer circuit 10 can include a plurality of compressors 15. In some embodiments, the plurality of compressors 15 can include compressors having different capacities.

The heat transfer circuit 10 can generally be applied in a variety of systems used to control an environmental condition (e.g., temperature, humidity, air quality, or the like) in a space (generally referred to as a conditioned space). Examples of systems include, but are not limited to, heating, ventilation, and air conditioning (HVAC) systems, transport refrigeration systems, or the like.

The components of the heat transfer circuit 10 are fluidly connected. The heat transfer circuit 10 can be specifically configured to be a cooling system (e.g., an air conditioning system) capable of operating in a cooling mode. Alternatively, the heat transfer circuit 10 can be specifically configured to be a heat pump system which can operate in both a cooling mode and a heating/defrost mode.

Heat transfer circuit 10 operates according to generally known principles. The heat transfer circuit 10 can be configured to heat or cool a heat transfer fluid or medium (e.g., a liquid such as, but not limited to, water or the like), in which case the heat transfer circuit 10, in some embodiments, may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump. In some embodiments, the air conditioner or heat pump can be included, for example, in a rooftop HVAC unit or the like.

In operation, the compressor 15 compresses a heat transfer fluid (e.g., refrigerant or the like) from a relatively lower pressure gas to a relatively higher-pressure gas. The relatively higher-pressure gas is discharged from the compressor 15 and flows through the condenser 20. In accordance with generally known principles, the heat transfer fluid flows through the condenser 20 and rejects heat to a heat transfer fluid or medium (e.g., water, air, etc.), thereby cooling the heat transfer fluid. The cooled heat transfer fluid, which is now in a liquid form, flows to the expander 25. The expander 25 reduces the pressure of the heat transfer fluid. As a result, a portion of the heat transfer fluid is converted to a gaseous form. The heat transfer fluid, which is now in a mixed liquid and gaseous form flows to the evaporator 30. The heat transfer fluid flows through the evaporator 30 and absorbs heat from a heat transfer medium (e.g., water, air, etc.), heating the heat transfer fluid, and converting it to a gaseous form. The gaseous heat transfer fluid then returns to the compressor 15. The above-described process continues while the heat transfer circuit is operating, for example, in a cooling mode (e.g., while the compressor 15 is enabled).

Figure 2:
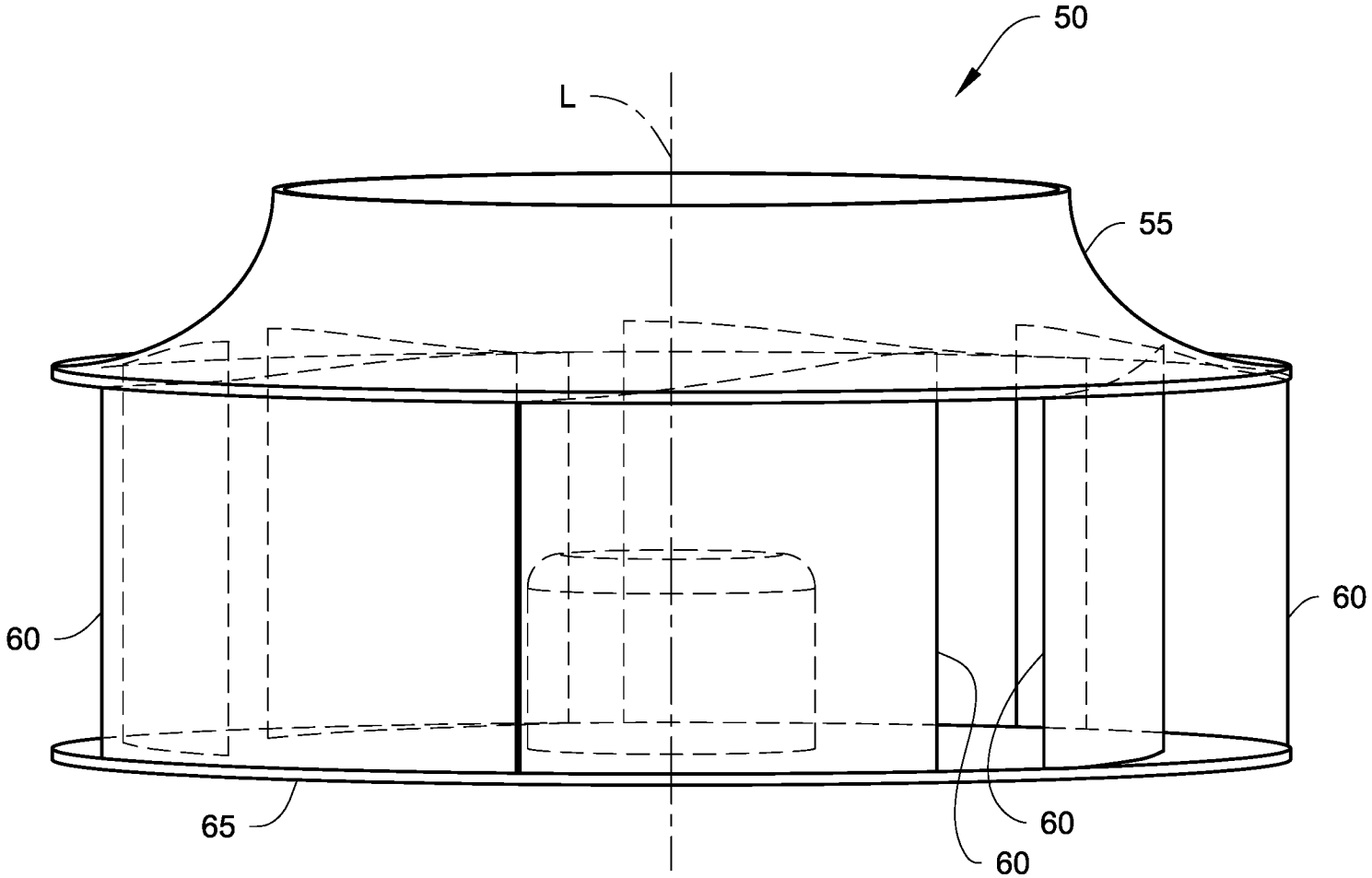
FIG. 2 illustrates a blower for an HVACR unit, according to an embodiment.

FIG. 2 illustrates a blower 50 for an HVACR unit, according to an embodiment. The blower 50 can alternatively be referred to as the centrifugal blower 50, the impeller 50, or the like, according to an embodiment.

The blower 50 includes a shroud 55 (e.g., a first shroud), a plurality of blades 60, and a shroud 65 (e.g., a second shroud). It will be appreciated that the blades may be applicable to blower designs using a static blade or rotating blade. In an embodiment, the blower 50 and methods herein may be used for any centrifugal blower type. In an embodiment, the blower 50 may be representative of a shrouded impeller. In an embodiment, the blower is a centrifugal blower. In an embodiment, the centrifugal blower has a backward curved blade. It is to be appreciated that the concepts described in this Specification can be applied to a shrouded impeller having a different blade geometry (e.g., forward curved or the like). A longitudinal axis L extends through a central opening of the blower 50.

The blower 50 can be made of, for example, plastic. The plastic can be, for example, a plastic suitable for manufacturing via a 3D printing process. The blower 50 is generally formed by a 3D printing process such as, but not limited to, selective laser sintering (SLS), multi jet fusion (MJF), fused deposition modeling (FDM), or the like. It will be appreciated that other processes may be employed for forming the blower, including but not limited to rapid prototyping, and such processes including selective laser sintering (SLS), selective laser melting (SLM), stereolithography (SLA), and 3D metal printing. In an embodiment, SLS can work with materials such as for example, metals, plastics, ceramics, carbon compounds and rubber, etc. 3D metal printing may include a type of additive manufacturing technology (i.e. not subtractive), which can mean that the material is gradually added to obtain the finished result rather than being taken away (e.g. such as in turning or milling). It will also be appreciated that other processes may be employed to obtain the blower, such as silicone molding, casting, and the like.

In an embodiment, it will be appreciated that the materials used for the blower can include plastic materials such as but not limited to variants of polyamide (e.g. Nylon), polycarbonate, glass reinforced or carbon fiber reinforced versions of either of these materials, ABS (Acrylonitrile butadiene styrene), ASA (Acrylonitrile styrene acrylate), and the like.

Figure 3:
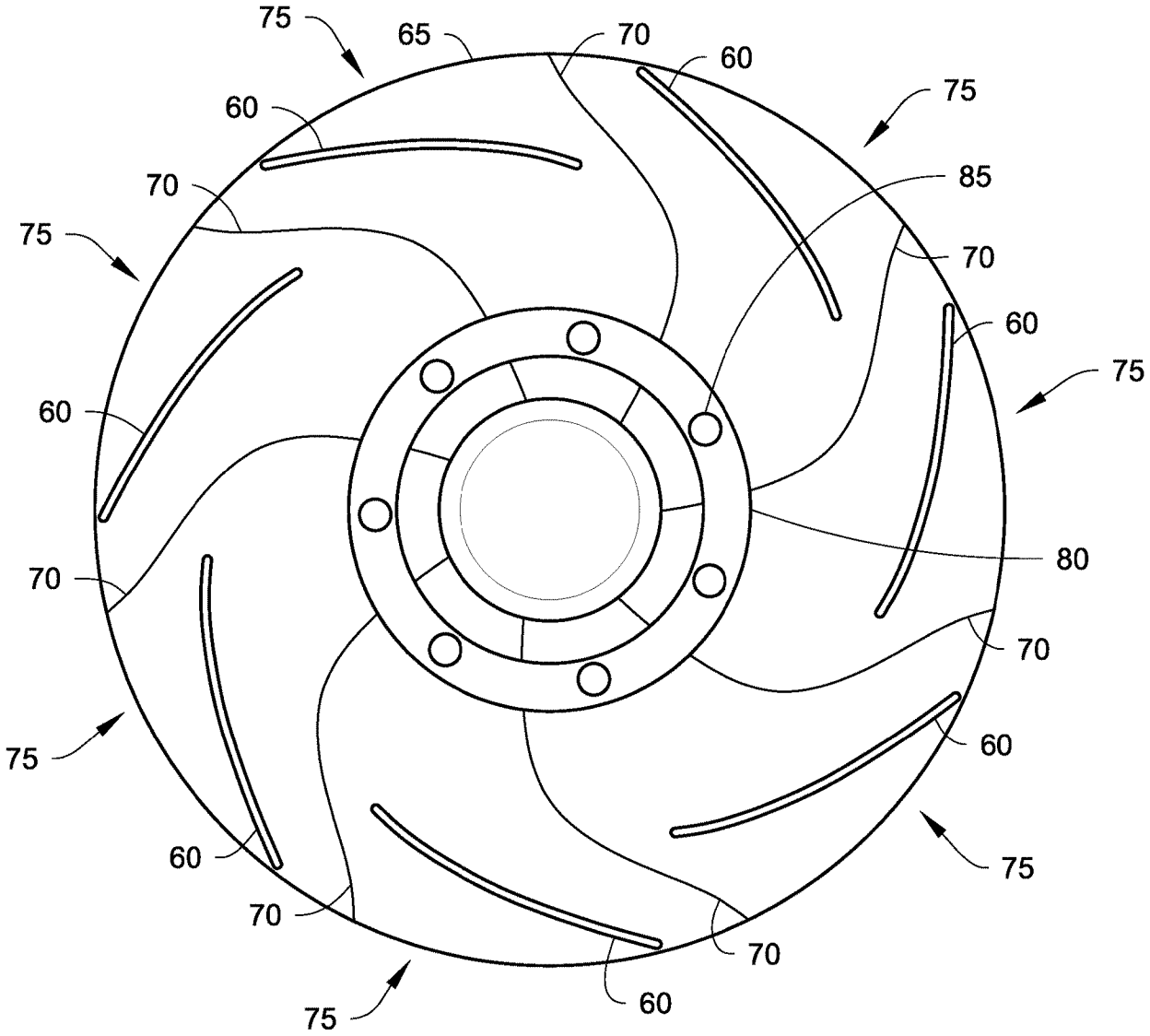
FIG. 3 illustrates a bottom plan view of the blower of FIG. 2, according to an embodiment.

FIG. 3 illustrates a bottom plan view of the blower 50, according to an embodiment.

In the illustrated embodiment, the shroud 65 is shown with a plurality of cut lines 70. Each cut line 70 is representative of a location at which the blower 50 is divided into individual sections for manufacturing purposes. That is, each of the sections 75 are bounded by two cut lines 70 or, alternatively stated, the cut lines 70 are representative of the extents of each of the sections 75 of the blower 50.

The cut lines 70 are curved in one embodiment. The illustrated embodiment shows cut lines 70 as curved as one non-limiting example. It is to be appreciated that the cut lines 70 can be any suitable cut line that can obtain separate blower sections (e.g. blower sections 75). In an embodiment, the blower sections can in some circumstances be equivalently shaped radial blower sections.

Other types of cut lines can include for example, straight cut lines, straight lines that come together at an angle, or lines of any suitable interlocking pattern, such as for example, tongue and groove, or combinations thereof, including curved lines.

In an embodiment, the cut lines 70, and accordingly the geometry of each of the sections 75 of the blower 50, are selected so that each section 75 of the blower 50 is formed to include the one of the blades 60. Additionally, the cut lines 70 are included in a manner that each section 75 is the same or substantially the same. In this Specification, substantially the same means the same subject to manufacturing tolerances or the like. Having the same or substantially the same sections 75 can, for example, simplify a manufacturing and assembly process by reducing a number of parts and a complexity of assembling the parts.

In the illustrated embodiment, the blower 50 includes seven sections 75. It is to be appreciated that the number of sections can vary beyond or below seven. For example, in an embodiment, the blower 50 can be divided into and produced from fewer sections 75 than seven, while in another embodiment, the blower 50 can be divided into and produced from more sections 75 than seven. In an embodiment, the number of sections 75 of which the blower 50 is formed is representative of a factor by which a size of the component being printed is reduced. For example, the illustrated embodiment includes seven blades and seven sections 75. As a result, the manufacturing process includes a plurality of components that are $1/7^{th}$ the size of the blower 50, and thus the size of each component being printed is relatively smaller than printing the entire blower as a single piece (or even as two pieces assembled together). This can, for example, reduce an amount of heat warpage caused by the manufacturing process.

A band 80 is secured to the shroud 65 via a plurality of apertures 85. The band 80 can be secured by a fastener such as, but not limited to, a screw, a bolt, a rivet, or the like. In an embodiment, the band 80 can be secured via an adhesive. In an embodiment, the band 80 maybe secured through heat staking, which may improve the overall process by reducing hardware assembly needs and assembly time. In an embodiment, the band 80 can be secured via an adhesive and a fastener. In the illustrated embodiment, the band is a ring. It is to be appreciated that the geometry of the band 80 can be based on the shroud 65 geometry. In an embodiment, the band 80 can also provide a mounting location for securing a motor to the blower 50.

Figure 4:
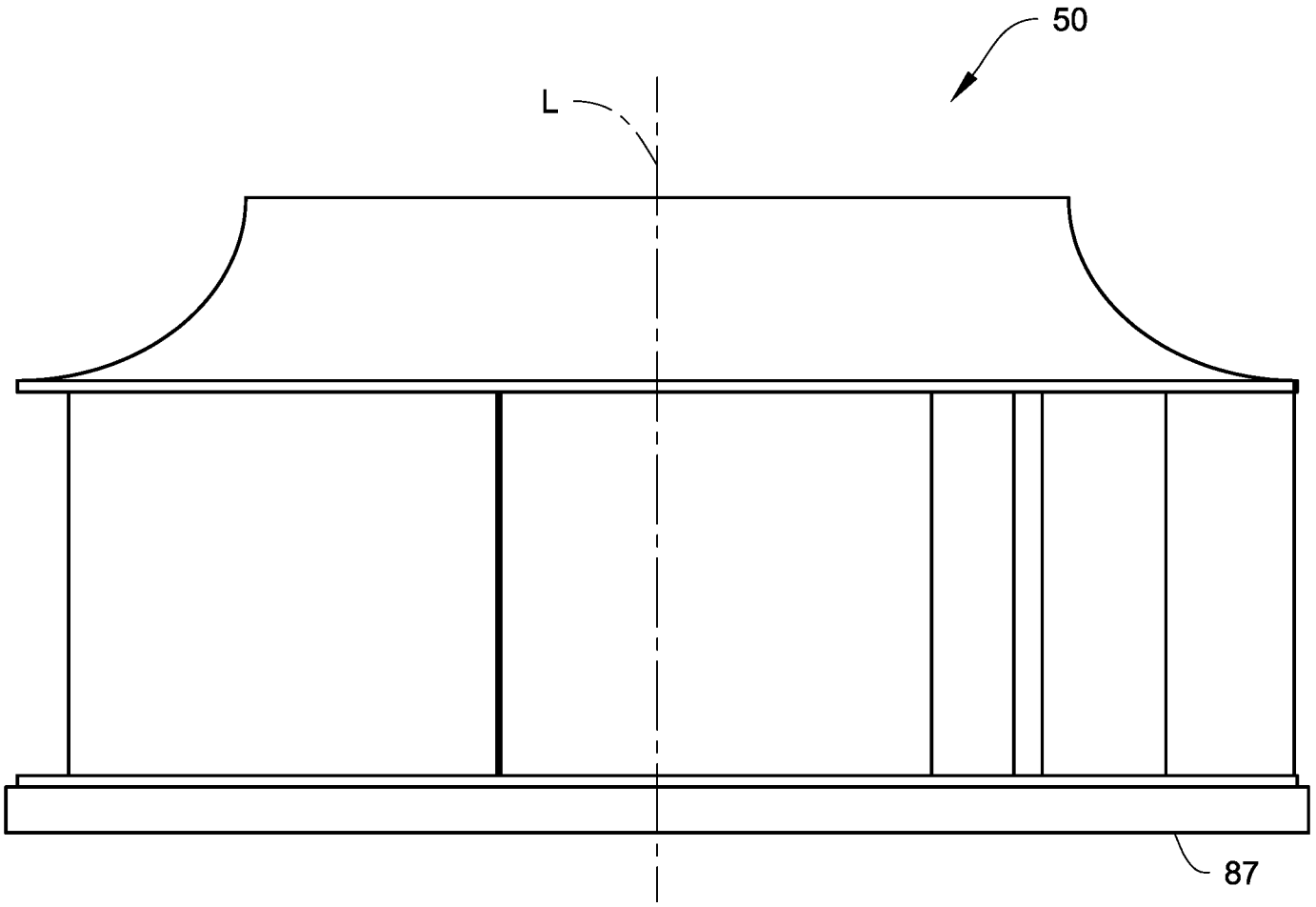
FIG. 4 illustrates a side view of the blower 50 of FIGS. 2 and 3, according to an embodiment.

FIG. 4 illustrates a side view of the blower 50 of FIGS. 2 and 3, according to an embodiment. As can be seen in FIG. 4, the blower 50 includes a band 87. The band 87, similar to the band 80, can be secured by a fastener such as, but not limited to, a screw, a bolt, a rivet, or the like. In an embodiment, the band 87 can be secured via an adhesive. In an embodiment, the band 80 maybe secured through heat staking, which may improve the overall process by reducing hardware assembly needs and assembly time. In an embodiment, the band 87 can be secured via an adhesive and a fastener. In the illustrated embodiment, the band is a ring. It is to be appreciated that the geometry of the band 87 can be based on the shroud 65 geometry. In an embodiment, the band 87 may be an outer band, where band 80 may be an inner band.

Figure 5:
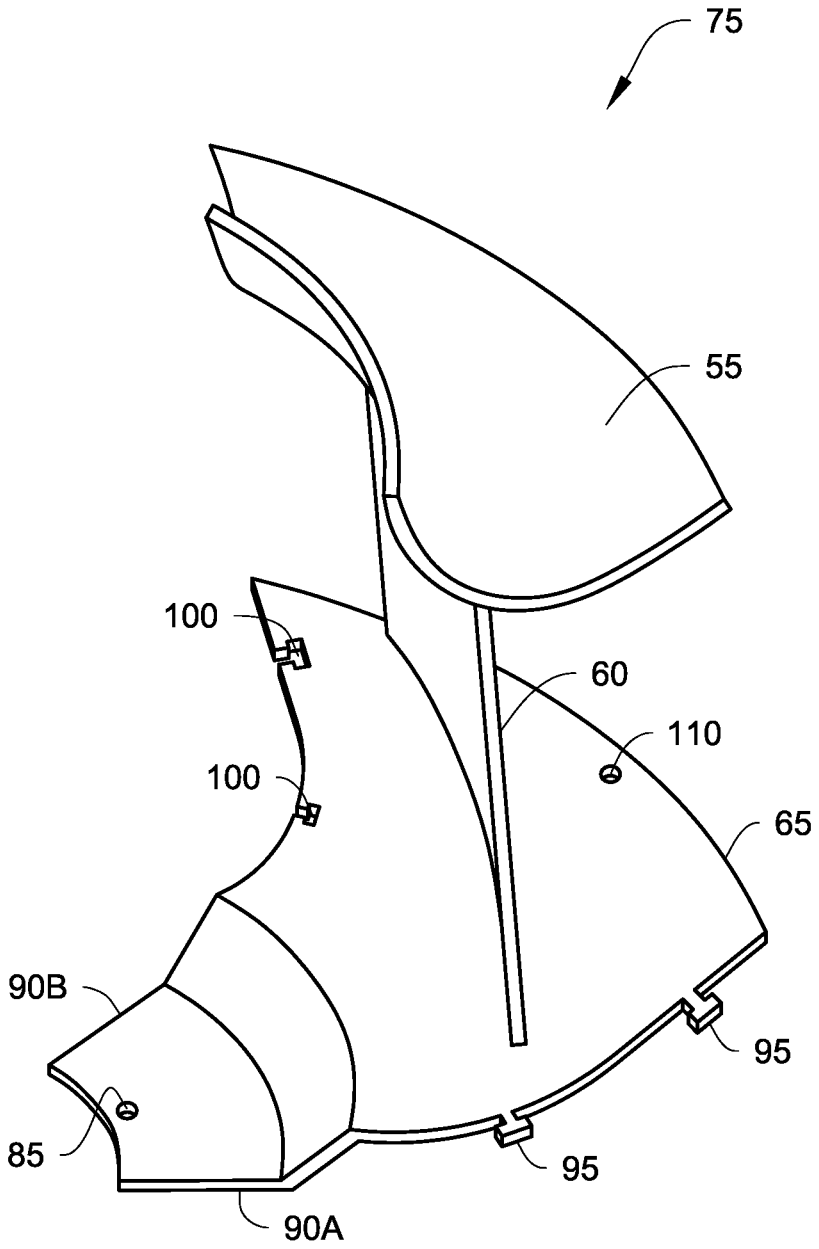
FIG. 5 illustrates one of a plurality of sections of the blower of FIGS. 2-4, according to an embodiment.

FIG. 5 illustrates one of the plurality of sections 75 of the blower 50 of FIGS. 2-4, according to an embodiment. The section 75 includes the shroud 55, the blade 60, and the shroud 65. Radial edges 90A and 90B of the section 75 would be aligned with the cut lines 70 from FIG. 3. The section 75, including the three components 55-65, is formed of a single piece, unitary construction. Generally, the section 75 is formed via a 3D printing process. It is to be appreciated that the individual piece could alternatively be formed by an injection molding process.

In the illustrated embodiment, the radial edge 90A includes a plurality of protrusions 95 and the radial edge 90B includes a plurality of openings 100. It will be appreciated that the locations of the protrusions and openings are interchangeable as to which radial edge they are on. The plurality of protrusions 95 and the plurality of openings 100 are designed such that they are joinable. For example, another section (not shown) would be joinable to either the radial edge 90A by inserting the protrusions 95 into the openings 100 of the another section or by inserting protrusions 95 of the another section into the openings 100 of the section 75. This can, for example, simplify an assembly process by maintaining a partially secured connection until such time as the bands 80 and 87 are secured to the blower 50.

In the illustrated embodiment, two protrusions 95 and two openings 100 are illustrated. It is to be appreciated that this is an example and the number of protrusions 95 and openings 100 can vary so long as the number of protrusions 95 and the number of openings 100 is the same. For example, there can be a single protrusion 95 and opening 100 in an embodiment, or three or more protrusions 95 and three or more openings 100 in another embodiment. The section 75 additionally includes the plurality of apertures 85 and a plurality of apertures 110 for receiving fasteners of the bands 80 and 87. It is to be appreciated that if the bands 80, 87 are joined via an adhesive, the apertures 85 and 110 may or may not be included.

Figure 6:
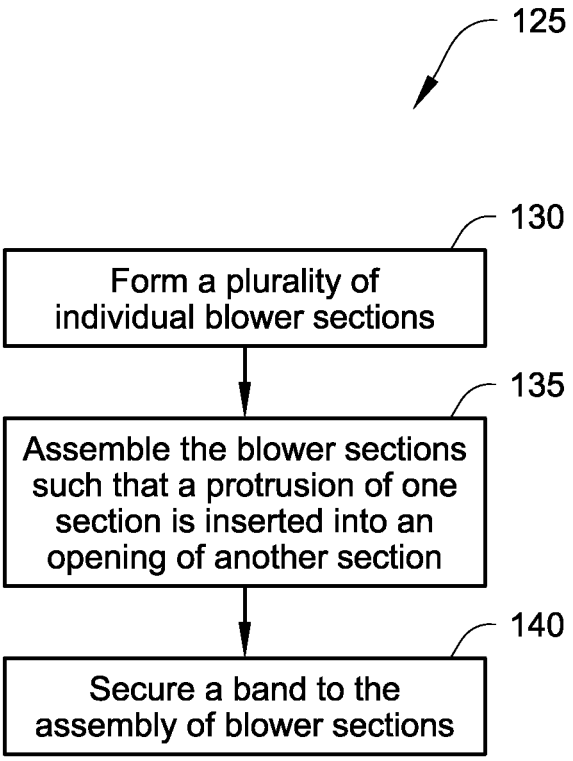
FIG. 6 is a flowchart of a method for manufacturing a blower, according to an embodiment.

FIG. 6 illustrates a flowchart of a method 125 for manufacturing a blower, according to an embodiment. The method 125 is representative of a method for manufacturing the blower 50 as shown and described in accordance with FIGS. 2-5 above.

At 130, a plurality of individual sections (e.g., the sections 75) is formed. The sections 75 can be formed via an injection molding, a 3D printing process, or the like. Each of the sections 75 includes first and second shroud portions 55, 65 and a blade 60. The plurality of sections 75 generally includes a protrusion and an opening along radial edges of the section to facilitate assembly of the sections 75.

At 135, the plurality of individual sections 75 is placed together such that protrusions of one section are assembled into openings of another section.

At 140, when all sections 75 are in place such that the blower 50 is assembled, one or more bands (e.g., bands 80, 87) are secured to the blower 50. In an embodiment, this can include one or more of securing via an adhesive, via one or more fasteners, or the like.

In another embodiment, it will be appreciated that the band may be first laid on a surface such as a table and then the individual pieces are placed over the band, located with respect to each other using the protrusions and openings and then the fasteners are shot through the band into the sections.

Aspects

It is noted that any of aspects 1-10 can be combined with any one of aspects 11-18.

Aspect 1. A blower for a heating, ventilation, air conditioning, and refrigeration (HVACR) unit, comprising: a plurality of blower sections, each section including: a first shroud, a second shroud spaced from the first shroud in a direction of a longitudinal axis of the blower, and a blade, the blade being formed such that a first end of the blade is joined with the first shroud and a second end of the blade is joined with the second shroud; and a band secured to the plurality of blower sections.

Aspect 2. The blower of aspect 1, wherein the plurality of blower sections are plastic, metal, a composite material, or a printed composite material.

Aspect 3. The blower of one of aspects 1 or 2, wherein each of the plurality of blower sections is formed of a single piece, unitary construction.

Aspect 4. The blower of any of aspects 1-3, wherein the first shroud of each of the plurality of blower sections includes a protrusion on a first radial edge of the first shroud and an opening on a second radial edge of the first shroud, the first and second radial edges being spaced circumferentially from each other.

Aspect 5. The blower of aspect 4, wherein the protrusion of a first of the plurality of blower sections is inserted into the opening of a second of the plurality of blower sections.

Aspect 6. The blower of any of aspects 1-5, wherein the band is secured to the plurality of blower sections by one or more of a fastener or an adhesive.

Aspect 7. The blower of any of aspects 1-6, wherein the blower is a centrifugal blower having a backward curved blade.

Aspect 8. The blower of any of aspects 1-7, wherein a number of sections in the plurality of sections is based on a number of blades for the blower.

Aspect 9. The blower of any of aspects 1-8, wherein each of the plurality of sections is the same.

Aspect 10. The blower of any of aspects 1-9, wherein the band is a ring.

Aspect 11. A method of manufacturing a blower for a heating, ventilation, air conditioning, and refrigeration (HVACR) unit, comprising: forming a plurality of sections of the blower, each section including a first shroud, a second shroud spaced from the first shroud in a direction of a longitudinal axis of the blower, and a blade, the blade being formed such that a first end of the blade is joined with the first shroud and a second end of the blade is joined with the second shroud; and securing a band to the plurality of sections.

Aspect 12. The method of aspect 11, wherein the forming includes forming the plurality of sections from a plastic material.

Aspect 13. The method of any of aspects 11 or 12, wherein the forming includes a 3D printing process.

Aspect 14. The method of aspect 13, wherein the 3D printing process includes selective laser sintering, multi-jet fusion, or fused deposition modeling.

Aspect 15. The method of any of aspects 11 or 12, wherein the forming includes an injection molding process.

Aspect 16. The method of any of aspects 11-15, wherein the forming includes forming each section as a single piece, unitary construction.

Aspect 17. The method of any of aspects 11-16, further comprising assembling the plurality of sections together to form the blower.

Aspect 18. The method of aspect 17, wherein the assembling includes inserting a protrusion on a first radial edge of the first shroud of a first of the plurality of sections into an opening on a second radial edge of the first shroud on a second of the plurality of sections.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A blower for a heating, ventilation, air conditioning, and refrigeration (HVACR) unit, comprising:

a plurality of blower sections, each section including:

a first shroud, a second shroud spaced from the first shroud in a direction of a longitudinal axis of the blower, and a blade, the blade being formed such that a first end of the blade is joined with the first shroud and a second end of the blade is joined with the second shroud; and a band secured to the plurality of blower sections, wherein the first shroud of each of the plurality of blower sections includes a protrusion on a first radial edge of the first shroud and an opening on a second radial edge of the first shroud, the first and second radial edges being spaced circumferentially from each other.

2. The blower of claim 1, wherein the plurality of blower sections are plastic, metal, a composite material, or a printed composite material.

3. The blower of claim 1, wherein each of the plurality of blower sections is formed of a single piece, unitary construction.

4. The blower of claim 1, wherein the protrusion of a first of the plurality of blower sections is inserted into the opening of a second of the plurality of blower sections.

5. The blower of claim 1, wherein the band is secured to the plurality of blower sections by one or more of a fastener or an adhesive.

6. The blower of claim 1, wherein the blower is a centrifugal blower having a backward curved blade.

7. The blower of claim 1, wherein a number of sections in the plurality of sections is based on a number of blades for the blower.

8. The blower of claim 1, wherein each of the plurality of sections is the same.

9. The blower of claim 1, wherein the band is a ring.

10. A method of manufacturing a blower for a heating, ventilation, air conditioning, and refrigeration (HVACR) unit, comprising:

forming a plurality of sections of the blower, each section including a first shroud, a second shroud spaced from the first shroud in a direction of a longitudinal axis of the blower, and a blade, the blade being formed such that a first end of the blade is joined with the first shroud and a second end of the blade is joined with the second shroud;

securing a band to the plurality of sections, and assembling the plurality of sections together to form the blower, wherein the assembling includes inserting a protrusion on a first radial edge of the first shroud of a first of the plurality of sections into an opening on a second radial edge of the first shroud on a second of the plurality of sections.

11. The method of claim 10, wherein the forming includes forming the plurality of sections from a plastic material.

12. The method of claim 11, wherein the forming includes a 3D printing process.

13. The method of claim 12, wherein the 3D printing process includes selective laser sintering, multi-jet fusion, or fused deposition modeling.

14. The method of claim 11, wherein the forming includes an injection molding process.

15. The method of claim 10, wherein the forming includes forming each section as a single piece, unitary construction.

16. A blower for a heating, ventilation, air conditioning, and refrigeration (HVACR) unit, comprising:

a plurality of blower sections, each section including:

a first shroud, a second shroud spaced from the first shroud in a direction of a longitudinal axis of the blower, and a blade, the blade being formed such that a first end of the blade is joined with the first shroud and a second end of the blade is joined with the second shroud; and a band secured to at least one aperture of the first shroud of the plurality of blower sections by a fastener.

17. The blower of claim 16, wherein the plurality of blower sections are plastic, metal, a composite material, or a printed composite material.

18. The blower of claim 16, wherein each of the plurality of blower sections is formed of a single piece, unitary construction.

19. The blower of claim 16, wherein the first shroud of each of the plurality of blower sections includes a protrusion on a first radial edge of the first shroud and an opening on a second radial edge of the first shroud, the first and second radial edges being spaced circumferentially from each other.

20. The blower of claim 16, wherein each of the plurality of sections is the same.

* * * * *